US007572050B2

(12) United States Patent
Bitterli et al.

(10) Patent No.: US 7,572,050 B2
(45) Date of Patent: Aug. 11, 2009

(54) ASSEMBLY ELEMENT INCLUDING FORK SHAPED ELASTIC STRUCTURES AND TIMEPIECE INCLUDING THE SAME

(75) Inventors: Roland Bitterli, Neuchâtel (CH); Wilfried Noell, Neuchâtel (CH); Fabien Blondeau, Le Landeron (CH); Lionel Paratte, Neuchâtel (CH); Toralf Scharf, Neuchâtel (CH); Pierre-André Meister, Bienne (CH); André Zanetta, Neuchâtel (CH)

(73) Assignee: ETA SA Manufacture Horlogére Suisse, Grenchen (CH)

( * ) Notice: Subject to any disclaimer, the term of this patent is extended or adjusted under 35 U.S.C. 154(b) by 0 days.

(21) Appl. No.: 11/937,696

(22) Filed: Nov. 9, 2007

(65) Prior Publication Data

US 2008/0112274 A1 May 15, 2008

(30) Foreign Application Priority Data

Nov. 9, 2006 (EP) ..... 06123783

(51) Int. Cl.
*G04B 29/00* (2006.01)
*G04B 31/00* (2006.01)

(52) U.S. Cl. ..... 368/324; 368/322

(58) Field of Classification Search ..... 368/322–326, 368/332, 44, 328, 80; 116/332, 328
See application file for complete search history.

(56) References Cited

U.S. PATENT DOCUMENTS 185,272 A * 12/1876 Weston ..... 116/332
267,824 A * 11/1882 Bell ..... 368/238
1,645,510 A 10/1927 Wood
3,306,027 A 2/1967 Schneider
3,738,152 A 6/1973 Green
3,922,041 A 11/1975 Quaile et al.
4,127,928 A * 12/1978 Green ..... 29/453

(Continued)

FOREIGN PATENT DOCUMENTS

EP 1659460 5/2006

(Continued)

OTHER PUBLICATIONS

European Search Report issued in corresponding application No. EP 06 12 3783, completed Aug. 6, 2007.

(Continued)

*Primary Examiner*—Vit W Miska
*Assistant Examiner*—Sean Kayes
(74) *Attorney, Agent, or Firm*—Griffin & Szipl, P.C.

(57) ABSTRACT

Assembly element made in a plate of brittle material, such as silicon, in particular for a timepiece, including an aperture provided for the axial insertion of an arbour, the inner wall of the aperture including elastic structures which are etched into the plate and which each include at least one support surface for gripping the arbour radially in order to secure the assembly element relative to the arbour. Each elastic structure is formed by a fork which is connected to the inner wall of the aperture by a bridge of material and which includes two branches extending, on either side of the bridge of material, generally towards the arbour. Each branch includes a support surface in proximity to the free end thereof. The invention also proposes a timepiece fitted with an assembly element of this type.

18 Claims, 3 Drawing Sheets

U.S. PATENT DOCUMENTS

| | | | |
|---|---|---|---|
| 4,358,166 | A | 11/1982 | Antoine |
| 6,453,772 | B1 | 9/2002 | Moskob |
| 2003/0007706 | A1 | 1/2003 | Suh et al. |
| 2006/0055097 | A1 | 3/2006 | Conus et al. |

FOREIGN PATENT DOCUMENTS

| | | | |
|---|---|---|---|
| EP | 1655642 | | 10/2006 |
| EP | 1708045 | A2 | 10/2006 |
| FR | 2006825 | | 1/1970 |

OTHER PUBLICATIONS

Office Action issued in related co-pending U.S. Appl. No. 11/937,789, dated Jun. 11, 2008.

Notice of Allowance issued in related co-pending U.S. Appl. No. 11/937,738, dated Jun. 13, 2008.

Austrian search report issued in corresponding Singapore application No. 200717510-2, dated Sep. 10, 2008.

* cited by examiner

ASSEMBLY ELEMENT INCLUDING FORK SHAPED ELASTIC STRUCTURES AND TIMEPIECE INCLUDING THE SAME

This application claims priority from European Patent Application No. 06123783.0 filed 9 Nov. 2006, the entire disclosure of which is incorporated herein by reference.

BACKGROUND OF THE INVENTION

The invention concerns an assembly element and a timepiece including the same.

The invention concerns more specifically an assembly element made in a plate of brittle material such as silicon, particularly for a timepiece, including an aperture provided for the axial insertion of an arbour, the inner wall of the aperture including elastic structures which are etched in the plate and which each comprise at least one support surface for gripping or squeezing the arbour radially in order to secure the assembly element relative to the arbour.

Generally, in timepieces, the assembly elements such as the timepiece hands and the toothed wheels are secured by being driven onto their rotating arbour, i.e. a hollow cylinder is forced onto a pin whose diameter is slightly greater than the inner diameter of the cylinder. The elastic and plastic properties of the material employed, generally a metal, are used for driving in said elements. For components made of a brittle material such as silicon, which does not have a usable plastic range, it is not possible to drive a hollow cylinder onto a conventional rotating arbour like those used in mechanical watchmaking, with a diameter tolerance of the order of +/−5 microns.

Moreover, the solution for securing an assembly element such as a hand must provide sufficient force to hold the element in place in the event of shocks. The force necessary for a conventional timepiece hand is, for example, of the order of one Newton.

In order to overcome these problems, it has already been proposed to make, in an assembly element such as a silicon balance spring collet, flexible strip shaped elastic structures arranged on the periphery of the aperture, so as to secure the collet onto an arbour by a driving in type arrangement, using the elastic deformation of the strips to grip the arbour and retain the collet on the arbour. An example of this type of securing method is disclosed in particular in EP Patent No. 1 655 642.

This solution is not completely satisfactory, particularly because of the significant stiffness of these flexible strips, which can cause mounting problems. Moreover, this solution is not provided for securing a rotating element to its rotating arbour, which can lead to relative sliding between the two parts.

SUMMARY OF THE INVENTION

It is an object of the invention to overcome these problems by providing an improved elastic structure, particularly allowing the use of the assembly element as a rotating element in a timepiece mechanism, in particular as a timepiece hand.

Thus, the invention proposes an assembly element of the type described previously, characterized in that each elastic structure is formed by a fork that is connected to the inner wall of the aperture by a bridge of material and includes two branches extending on either side of the bridge of material, generally towards the arbour, and in that each branch includes a support surface in proximity to the free end thereof.

The assembly element according to the invention improves the gripping force against the arbour, to allow better distribution of the stress linked to the elastic deformation in the material forming the assembly element, and to allow better control of the gripping force obtained on the arbour, while remaining removed from the material breakage range.

Moreover, the elastic structures according to the invention offer radial clearance, after the elastic deformation of the latter, which is sufficient to compensate for the manufacturing tolerances applied to the diameter of an arbour such as those used in timepieces for driving the hands.

According to other features of the invention:

- each branch of the elastic structure has the shape of a substantially parabolic curve, one fixed end of which is arranged on the associated bridge of material and the second free end of which faces the free end of the other end of the elastic structure, and the support surface of each branch is arranged on the inner face of the free end section thereof;
- each elastic structure includes a main section that extends on either side of the bridge of material, and each branch extends, from one end of the main section opposite the bridge of material, along an inclined rectilinear direction towards the associated branch, relative to a radial direction, and the support surface of each branch is arranged at the free end thereof;
- the main section extends along a substantially circumferential direction;
- the inner wall of the aperture includes at least three elastic structures, which are regularly distributed around the arbour;
- a timepiece hand forms the assembly element.

The invention also proposes a timepiece characterized in that it includes at least one assembly element according to any of the preceding features.

Other features and advantages of the present invention will appear more clearly upon reading the following detailed description, made with reference to the annexed drawings, given by way of non limiting example, in which:

DESCRIPTION OF THE PREFERRED EMBODIMENTS

In the following description, identical or similar elements will be designated by the same references.

Figure 1:
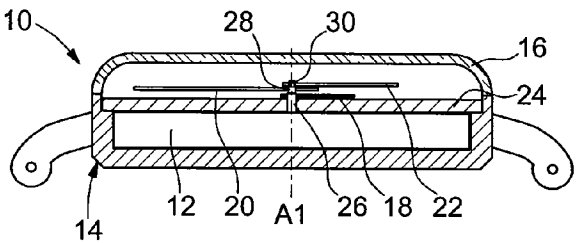
FIG. 1 is an axial cross-section that shows schematically a timepiece fitted with assembly elements formed by timepiece hands made in accordance with the teaching of the invention.

FIG. 1 shows schematically a timepiece 10 which is made in accordance with the teaching of the invention.

Timepiece 10 includes a movement 12 mounted inside a case 14 closed by a crystal 16. Movement 12 drives in rotation, about an axis A1, analogue display means formed here by an hour hand 18, a minute hand 20 and a second hand 22, these hands extending above a dial 24. Hands 18, 20, 22 are secured by being elastic gripped to coaxial cylindrical rotating arbours 26, 28, 30, in a driving in type arrangement, as will be seen hereafter.

Preferably, arbours 26, 28, 30 are conventional arbours commonly used in timepiece movements, for example metal or plastic arbours.

In the following description, we will use in a non-limiting manner, an axial orientation along rotational axis A1 of hands 18, 20, 22 and a radial orientation relative to axis A1. Moreover, elements will be termed inner or outer depending upon their radial orientation relative to axis A1.

Hands 18, 20, 22 form assembly elements, each hand 18, 20, 22 being made in a plate of brittle material, preferably a silicon based crystalline material and to be assembled on the arbour 26, 28, 30 thereof.

Figure 2:
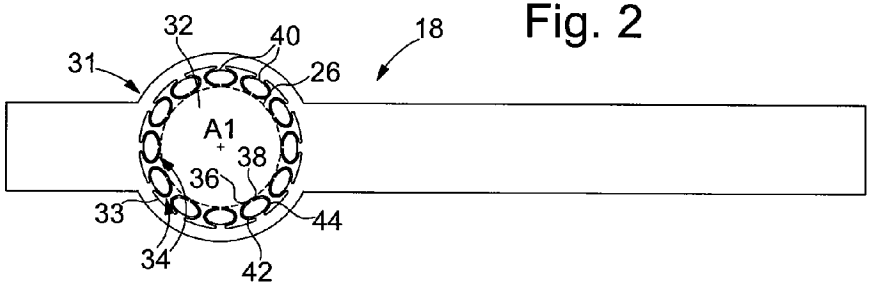
FIGS. 2 to 4 are top views that show schematically respectively the hour hand, the minute hand and the second hand fitted to the timepiece of FIG. 1 and which are provided with elastic structures in a C shaped embodiment.
Figure 3:
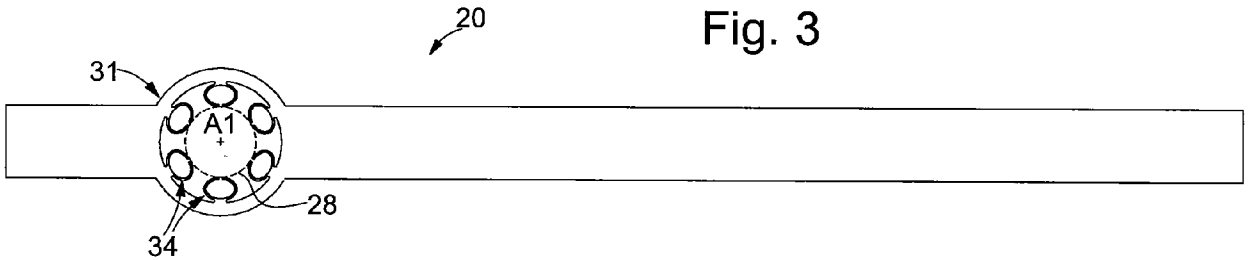
Figure 4:
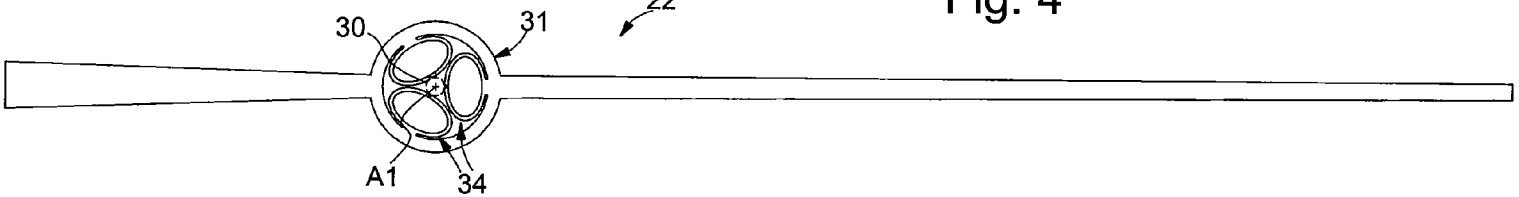

FIGS. 2, 3 and 4 show a first embodiment of the invention applied respectively hour hand 18, minute hand 20 and second hand 22. Each hand 18, 20, 22 includes here a mounting ring 31, which delimits an aperture 32 provided for securing the hand 18, 20, 22 to the associated arbour 26, 28, 30 by axial insertion into aperture 32. The inner wall 33 of aperture 32 includes elastic structures 34, which are etched in the plate forming mounting ring 31 and which each include support surfaces 36, 38 for radially gripping the associated arbour 26, 28, 30 in order to retain hand 18, 20, 22 axially and radially on arbour 26, 28, 30 and in order to secure the arbour and associated hand to each other in rotation.

In accordance with the teaching of the invention, each elastic structure 34 is formed by a fork, which is connected to the inner wall 33 of aperture 32 by a bridge of material 40 and which includes two branches 42, 44, extending, on either side of the bridge of material 40, generally towards arbour 26, 28, 30. Moreover, each branch 42, 44 includes a support surface 36, 38 in proximity to the free end 46, 48 thereof.

According to the first embodiment of the invention, which is illustrated by FIGS. 2 to 5, the two branches 42, 44 of each elastic structure 34 are bent towards each other forming an almost closed "C".

Figure 5:
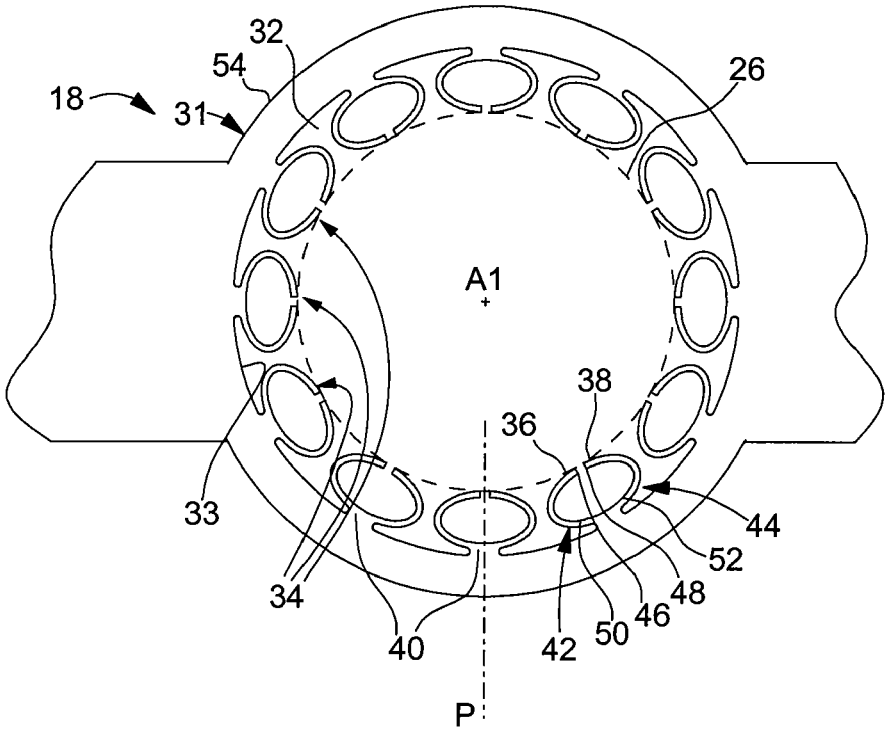
FIG. 5 is an enlarged view of one part of FIG. 2 which shows the hour hand mounting ring.

A first embodiment of elastic structures 34 according to the invention will now be described by examining hour hand 18, as shown in FIG. 2 and as shown in an enlarged manner in FIG. 5. It will be noted that elastic structures 34 are shown here at rest, i.e. prior to being deformed by the insertion of the associated arbour 26, 28, 30.

Each branch 42, 44 of each elastic structure 34 has the shape of a substantially parabolic curve a first fixed end 50, 52 of which is arranged on the associated bridge of material 40 and a second free end 46, 48 of which faces the free end 46, 48 of the other branch 42, 44 of elastic structure 34.

Preferably the free ends 46, 48 of branches 42, 44 of each elastic structure 34 are sufficiently close that the inner face of each branch 42, 44 is substantially tangent to the axial surface of arbour 26, in proximity to the free ends 46, 48, support surface 36, 38 of each branch 42, 44 thus being located on the inner face of the free end section thereof, opposite arbour 26.

When arbour 26 is inserted into aperture 32, the radial effort exerted on support surfaces 36, 38 causes an elastic deformation of the two branches 42, 44 of elastic structure 34, such that the free ends 46, 48 of branches 42, 44 move radially outwards. This elastic deformation generates radial gripping on arbour 26 similar to a driving in arrangement.

Preferably, elastic structures 34 are distributed regularly around axis A1.

Advantageously, for each hand 18, 20, 22, the number of elastic structures 34 arranged around aperture 32 is selected as a function of the diameter of the associated arbour 26, 28, 30 and as a function of the radial space available between the inner wall 33 of aperture 32 and outer wall 54 of mounting ring 31 of hand 18, 20, 22. Thus, the larger the diameter of the arbour 26, 28, 30 and the smaller the aforementioned radial space, the larger the number of elastic structures 34.

Thus, in this embodiment, since the diameter of arbour 26 associated with hour hand 18 is much greater than the diameter of the arbour 30 associated with second hand 22, and since the external diameter of mounting ring 31 does not change proportionally, we have selected a number of elastic structures 34 equal to twelve for hour hand 18, whereas the number of elastic structures 34 is equal to three for second hand 22. In an intermediate fashion, the number of elastic structures 34 in minute hand 20 is equal here to six.

It will be noted that making the securing system with at least three elastic structures 34 facilitates the centring of mounting ring 31 relative to the associated arbour 26, 28, 30.

Figure 6:
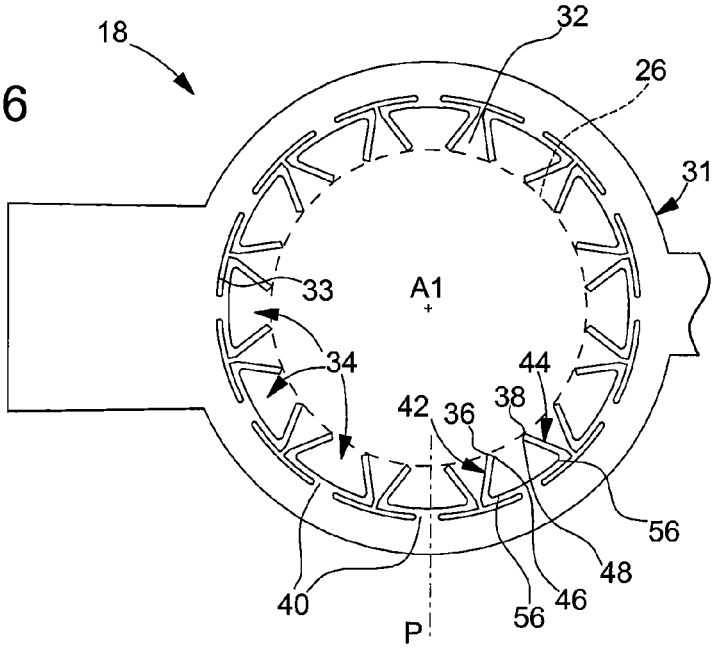
FIGS. 6 to 8 are similar views to those of FIGS. 2 to 4 which show schematically respectively the hour hand, the minute hand, and the second hand, when they are provided with elastic structures according to a second L shaped embodiment.
Figure 7:
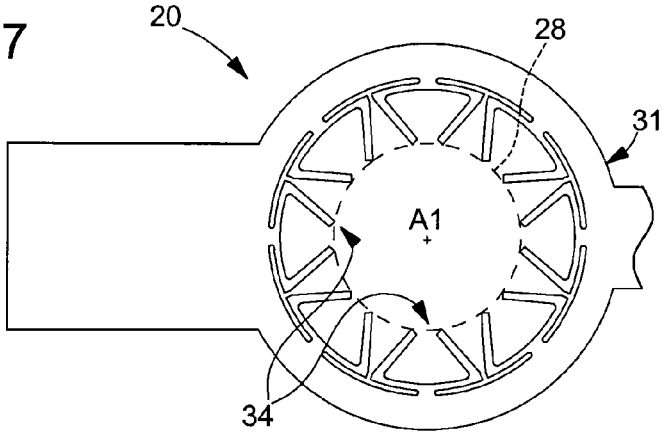
Figure 8:
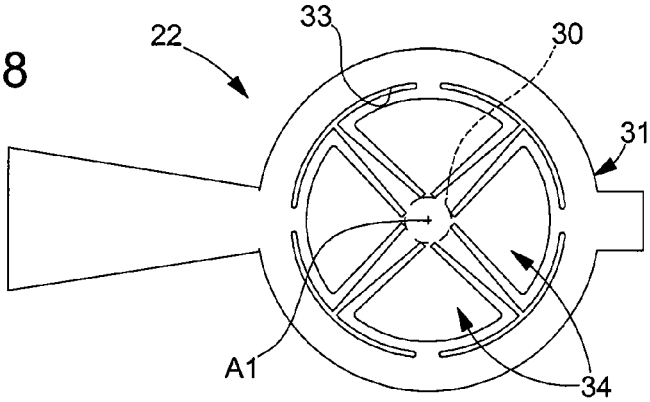

A second embodiment of elastic structures 34 is shown in FIGS. 6 to 8, which show mounting rings 31 respectively secured to hour hand 18, minute hand 20 and second hand 22. According to this second embodiment, each elastic structure 34 includes a main section 56 which extends on either side of bridge of material 40. Each branch 42, 44 extends, from the end of main section 56 opposite bridge of material 40, along a rectilinear direction. Each branch 42, 44 is inclined towards the associated branch 42, 44, relative to a radial direction. The support surface 36, 38 of each branch 42, 44 is arranged at the free end 46, 48 of branch 42, 44.

Preferably, the main section 56 of each elastic structure 34 extends along a substantially circumferential direction, parallel to the inner cylindrical wall 33 of aperture 32, which maximises the length of main section 56 and rectilinear branches 42, 44 in order to distribute the stresses linked to the elastic deformation of branches 42, 44 in a larger volume.

The second embodiment has the advantage of producing a self-locking effect, when arbour 26, 28, 30 and the associated hand 18, 20, 22 are assembled to each other. Indeed, the inclination of branches 42, 44 allows a dynamic reaction to an acceleration in rotation which makes this embodiment particularly suited to securing assembly elements subject to high angular accelerations or in the event that the rotating element has a significant unbalance in the distribution of weights, which is the case for the hands of a timepiece.

In the second embodiment, the two branches 42, 44 of each elastic structure 34 exert thrust efforts in opposite directions, such that each branch 42, 44 opposes the relative rotation of hand 18, 20, 22 relative to the associated arbour 26, 28, 30 in a preferred direction of rotation. In the example shown in FIG. 6, the first branch 42 of each elastic structure 34 opposes the relative rotation of hand 18 in the anticlockwise direction and the second branch 44 of each elastic structure 34 opposes the relative rotation of hand 18 in the clockwise direction. The elastic structures 34 of the second embodiment thus provide a particularly efficient securing arrangement in rotation between the hands 18, 20, 22 and the associated arbours 26, 28, 30.

Making elastic structures 34 in the form of forks including one section oriented tangentially or circumferentially (section 56) and a rectilinear section (branch 42, 44) oriented towards the associated arbour 26, 28, 30 reduces the stiffness of elastic structure 34 which allows a radial clearance of sufficient value to allow said structure to be secured to arbour 26, 28, 30, in particular to compensate for the arbour diameter tolerances. Each elastic structure 34 must have sufficient flexibility to be secured both to an arbour having a smaller diameter than the nominal value and to an arbour having a larger diameter than the nominal value.

The advantages mentioned here with reference to the second embodiment apply in part to the first embodiment, since making the elastic structures including two branches 42, 44 offers the advantage of a dynamic reaction to an angular acceleration. Moreover, the curved branches 42 of the first embodiment also allow a decrease in the stiffness of elastic structure 34 to be obtained and an adequate radial clearance for securing to the arbour.

It will be noted that, in the first and second embodiments, each elastic structure 34 have an axial plane of symmetry P which extends along a radius passing through the middle of bridge of material 40.

Although the present invention has been described in relation to assembly elements formed by hands 18, 20, 22, it is not limited to these embodiments. Thus, the assembly element could be formed by another type of rotating element, for example by a toothed wheel used in a timepiece movement. The assembly element could also be formed by a non rotating element, for example a plate of brittle material to be assembled on another element including a metal securing arbour, or stud.

The present invention is applicable to a hand 18, 20, 22 made in a silicon plate including a single silicon layer, and in an SOI (silicon on insulator) type silicon plate which includes a top layer and a bottom layer of silicon separated by an intermediate layer of silicon oxide.

What is claimed is:

1. An assembly element for a timepiece, the assembly element comprising:

a member made in a plate of brittle material with an aperture provided for axial insertion of an arbour, wherein an inner wall of the aperture includes elastic structures that are etched into the plate, and each elastic structure includes at least one support surface for gripping onto the arbour radially in order to secure the assembly element relative to the arbour, wherein each elastic structure is formed by a fork that is connected to the inner wall of the aperture by a bridge of material and the fork includes two branches extending, on either side of the bridge of material, generally towards the arbour, and wherein each branch includes a support surface that grips onto the arbour in proximity to a free end of the branch.

2. The assembly element according to claim 1, wherein each branch of the elastic structure has the shape of a substantially parabolic curve, one fixed end of which is arranged on the associated bridge of material and a second free end of which faces the free end of the other branch of the elastic structure, and wherein the support surface of each branch is arranged on an inner face of the free end section thereof.

3. The assembly element according to claim 2, wherein the two branches of each elastic structure are bent towards each other forming an almost closed "C" configuration.

4. The assembly element according to claim 1, wherein each elastic element includes a main section that extends on either side of the bridge of material, wherein each branch extends, from an end of the main section opposite the bridge of material, along an inclined rectilinear direction towards the associated branch, relative to a radial direction, and wherein the support surface of each branch is arranged at the free end thereof.

5. The assembly element according to claim 4, wherein the main section extends along a substantially circumferential direction.

6. The assembly element according to claim 4, wherein the two branches of each elastic structure are bent towards each other so that the main section and the two braches form an almost closed triangular configuration.

7. The assembly element according to claim 1, wherein the inner wall of the aperture includes at least three elastic structures that are regularly distributed around the arbour.

8. The assembly element according to claim 1, formed as a rotating element to be fixedly mounted in rotation to the arbour.

9. The assembly element according to claim 8, formed as a timepiece hand.

10. A timepiece including the assembly element according to claim 1.

11. The assembly element of claim 1, wherein said brittle material is silicon.

12. The assembly element according to claim 11, wherein each branch of the elastic structure has the shape of a substantially parabolic curve, one fixed end of which is arranged on the associated bridge of material and a second free end of which faces the free end of the other branch of the elastic structure, and wherein the support surface of each branch is arranged on an inner face of the free end section thereof.

13. The assembly element according to claim 11, wherein each elastic element includes a main section that extends on either side of the bridge of material, wherein each branch extends, from an end of the main section opposite the bridge of material, along an inclined rectilinear direction towards the associated branch, relative to a radial direction, and wherein the support surface of each branch is arranged at the free end thereof

14. The assembly element according to claim 13, wherein the main section extends along a substantially circumferential direction.

15. The assembly element according to claim 11, wherein the inner wall of the aperture includes at least three elastic structures that are regularly distributed around the arbour.

16. The assembly element according to claim 11, formed as a rotating element to be fixedly mounted in rotation to the arbour.

17. The assembly element according to claim 16, formed as a timepiece hand.

18. A timepiece including the assembly element according to claim 11.

* * * * *